US010550538B2

(12) United States Patent
Garnier et al.

(10) Patent No.: US 10,550,538 B2
(45) Date of Patent: Feb. 4, 2020

(54) METHOD FOR INSULATING SUB-SOIL

(71) Applicant: TOTAL SA, Courbevoie (FR)

(72) Inventors: André Garnier, Montardon (FR); Pascal Collet, Pau (FR); Erik Green, Pau (FR)

(73) Assignee: TOTAL SA, Courbevoie (FR)

( * ) Notice: Subject to any disclaimer, the term of this patent is extended or adjusted under 35 U.S.C. 154(b) by 0 days.

(21) Appl. No.: 15/311,761

(22) PCT Filed: May 15, 2015

(86) PCT No.: PCT/FR2015/051281
§ 371 (c)(1),
(2) Date: Nov. 16, 2016

(87) PCT Pub. No.: WO2015/173529
PCT Pub. Date: Nov. 19, 2015

(65) Prior Publication Data

US 2017/0089026 A1 Mar. 30, 2017

(30) Foreign Application Priority Data

May 16, 2014 (EP) ..... 14305723

(51) Int. Cl.
*E02D 27/35* (2006.01)
*E21B 7/00* (2006.01)
*E02D 3/12* (2006.01)

(52) U.S. Cl.
CPC ..... *E02D 27/35* (2013.01); *E02D 3/12* (2013.01); *E02D 3/126* (2013.01); *E21B 7/00* (2013.01); *E02D 2200/1692* (2013.01); *E02D 2250/003* (2013.01); *E02D 2250/0023* (2013.01); *E02D 2300/0046* (2013.01)

(58) Field of Classification Search
CPC ..... E02B 3/12; E02B 3/126
See application file for complete search history.

(56) References Cited

U.S. PATENT DOCUMENTS 3,577,893 A * 5/1971 Towner ..... E01C 3/04 404/31
3,598,184 A * 8/1971 Schuh ..... E21B 17/08 166/302

(Continued)

FOREIGN PATENT DOCUMENTS

FR 2 992 671 A1 1/2014
WO WO 95/21989 A1 8/1995

OTHER PUBLICATIONS

International Search Report for PCT/FR2015/051281, dated Aug. 12, 2015, 3 pages.

(Continued)

*Primary Examiner* — Tara Mayo-Pinnock
(74) *Attorney, Agent, or Firm* — Patterson Thuente Pedersen, P.A.

(57) ABSTRACT

This invention relates to a method for insulating sub-soil comprising mechanically destructuring the sub-soil, injecting an insulating material into the destructured sub-soil, and mixing the sub-soil and the insulating material. The thermal conductivity of the insulating material is strictly lower than the thermal conductivity of the sub-soil.

8 Claims, 3 Drawing Sheets

(56) References Cited

U.S. PATENT DOCUMENTS

| | | | | | |
|---|---|---|---|---|---|
| 3,618,680 | A | * | 11/1971 | Ellard | C09K 8/32 166/901 |
| 3,903,706 | A | | 9/1975 | Gzemski | |
| 5,845,720 | A | * | 12/1998 | Borjeson | E02D 19/16 175/19 |
| 5,980,446 | A | * | 11/1999 | Loomis | B09B 1/00 405/129.45 |

OTHER PUBLICATIONS

English translation of International Search Report for PCT/FR2015/051281, dated Aug. 12, 2015, 3 pages.
Written Opinion for PCT/FR2015/051281, dated Aug. 12, 2015, 5 pages.
English translation of Written Opinion for PCT/FR2015/051281, dated Aug. 12, 2015, 5 pages.

* cited by examiner

METHOD FOR INSULATING SUB-SOIL

RELATED APPLICATIONS

The present application is a National Phase entry of PCT Application No. PCT/FR2015/051281 filed May 15, 2015, which claims priority from EP Patent Application No. 14305723.0, filed May 16, 2014, said applications being hereby incorporated by reference herein in their entirety.

FIELD OF THE INVENTION

This invention relates to the field of building or of drilling in particular in the hypothesis where the ground is comprised of permafrost.

BACKGROUND OF THE INVENTION

Permafrost designates the portion of ground that is permanently frozen, at least for two years. Due to the existence of a very cold winter, the cold can penetrate deeply into the sub-soil. During the summer, the low heat does not make it possible to heat the sub-soil throughout its entire depth: certain portions of the sub-soil are as such constantly frozen.

However, if the permafrost thaws (artificially or naturally), the latter becomes unstable because its mechanical properties are modified. For example, the permafrost can be heated due to:

climate warming;

a drilling (mechanical friction of the drill in the sub-soil);

the operation of an existing production well (petrol or production gas being at temperatures higher than 0° C.);

the exothermic reaction of the hardening of concrete/cement (in case, in particular of an installation of a screed of concrete/cement on the ground or for the construction of a production well of which the walls would be cemented);

the simple presence of a building built on the ground, limiting as such the penetration of the cold under the building;

etc.

In the case where the permafrost thaws, any installations/buildings installed on it tend to sink into the sub-soil due to their own weight, as the thawing ground then loses its capacity to resist.

In order to prevent the thawing of the permafrost in the event of the present of a building, certain States have set down construction rules aiming to raise the buildings using piles and as such favour the penetration of the cold into the sub-soil (see for example "Construction Code and Regulation—Base and Foundations on the permafrost soils—SniP 2.02.04-88—USSR State Building and Construction Committee").

However, these methods do not allow for the construction of all types of buildings (e.g. buildings that must support substantial weights, roads, airport runways, drilling supports, storage zones, etc.).

In addition, these methods do not resolve the issues linked to the supplying of heat from a production well: there are as such risks of losing the confinement or stability for the well or the drilling tools. Some methods have proposed to insulate the well from the sub-soil by adding insulating materials in an annular space of the well. However, the latter are expensive because their insulating power has to be substantial, as the space available for the installation of these insulations is low in a well.

Inversely, in the framework of storing liquefied gases in the ground, it can be sought to prevent the freezing of the sub-soil which could provoke upheaving and damage to the confinement/storage. As such, normally, outside heating systems of the sub-soil are implemented and the walls of the storage structure are covered with an expensive and fragile insulation.

There is as such a need to facilitate the construction of buildings on the ground in permafrost zones and/or to insulate the production wells simply and economically.

SUMMARY OF THE INVENTION

To this effect, this invention proposes a versatile and economic method in order to solve the problems mentioned hereinabove.

This invention then relates to a method for insulating sub-soil comprising:

/a/ mechanically destructuring said sub-soil;

/b/ injecting an insulating material into said destructured sub-soil;

/c/ mixing said sub-soil and said insulating material.

The thermal conductivity of said insulating material is strictly lower than the thermal conductivity of the sub-soil.

The thermal conductivity of said insulating material can also be less than 2, 3, 4, 5, 10, 20, 30, 40, 50, 100, 200, 300, 400, 500, 1000 times the thermal conductivity of the sub-soil.

"Destructuring of a sub-soil" refers to the apparent and/or visual modification of its macroscopic structure with respect to an initial state considered as normal for the location under consideration. For example, the ploughing of a field makes it possible to destructure the surface of the ground. Destructuring makes it possible to lose the structure coherency that a compact sub-soil can have (on the scale of the centimetre or millimetre). As such, two portions of a destructured sub-soil no longer have any resistance to separation (or at the least less with respect to the initial resistance): if the minimum force, in laboratory conditions, required to dissociate two adjacent volumes insulated from a structured sub-soil is F, the minimum force, in laboratory conditions, required to dissociate two adjacent volumes insulated from a destructed sub-soil is less than F/2 (the elementary volume can be a cube with sides of 2 cm).

The simple injection of insulation into the ground (i.e. without mixing and destructuring) may not be satisfactory/sufficient for the embodiments under consideration as its distribution in the ground can be excessively inhomogeneous and require the presence of voids that can be filled in the sub-soil.

This method as such makes it possible to modify the thermal characteristics of the sub-soil in place without replacing it. This makes it possible in particular to:

reduce the excavated earth as much as possible (because the existing sub-soil is not entirely extracted but is reused in the mixture), reduce the superstructure or drilling works, sustain the structures and the stability of wellheads, reconsider the buried storage of liquefied gas (for example, increasing storage volumes, reducing insulation works, etc.).

In addition, this method makes it possible in particular to avoid building a bearing structure for a construction of a screed or of a building, with piles, above the permafrost and as such makes it possible to be able to install the structures directly on the ground. This makes it possible to reduce the quantities of piles and metal structures to be constructed while still facilitating the use and the operation of the buildings.

Moreover, in the case of drilling, this method can allow for a solution that is alternative or complementary to the insulation solutions in existing wells. By treating/insulating the sub-soil as described hereinabove, under the drilling installations, it is possible to reduce the issues with settling and degradation over time of the working zones.

Finally, in the framework of storing liquefied gas in a buried manner, it is possible to avoid, at least partially, systems for heating the apron. As such, by implementing the method described hereinabove, it is possible to extend the period of malfunction of the heating system before having an effect on the ground. Moreover, the existence of the insulated sub-soil makes it possible to reduce the heat requirements supplied by the heating system and therefore to reduce the operating cost of the storage device.

The mechanical destructuring can be carried out using an excavator or using a mechanical part (for example helical) set into rotation. Moreover, this destructuring can be carried out by means of a high-pressure jet of a liquid able to destructure the sub-soil.

The insulating material can advantageously be an insulation of the polyurethane or epoxy foam type conferring the qualities of resistance and solidity required as well as the thermal performance sought.

Advantageously, the destructuring of said sub-soil can comprise:

a drilling of an injection well in the sub-soil;

displacing an injection nozzle in the injection well;

injecting during said displacement of a destructuring fluid at high pressure able to destructure the sub-soil via said injection nozzle.

The injection of said insulation can then be carried out during said displacement.

Furthermore, the mixture of said sub-soil and of said insulating material can comprise a rotation of a mechanical shaft in said sub-soil.

In an embodiment, the insulating material can comprise a material that solidifies after injection.

As such, this insulation confers increased solidity of the sub-soil as well as a seal.

Advantageously, the solidification can comprise an exothermic reaction.

This exothermic reaction can as such thaw, temporarily the permafrost in contact with the insulation in the process of solidification and as such increase the zone in which the insulation is mixed in the sub-soil.

The insulating material comprises a hydrophobic material. As such, the seal of the portions of the treated sub-soil can be increased.

In a particular embodiment, the temperature of said destructuring fluid can be 20° C. higher than a temperature of the ground.

As such, if the sub-soil is frozen, the destructuring power of said fluid is increased without increasing the pressure for the injection. Destructuring is as such facilitated and the effectiveness of the method is increased.

The method can further comprise a drilling of a production well in said sub-soil mixed with said insulating material.

Advantageously, the mixed sub-soil has the shape of an inverted cone (for example, an inverted pyramid).

BRIEF DESCRIPTION OF THE DRAWINGS

Other characteristics and advantages of the invention shall further appear when reading the following description. The latter is purely for the purposes of illustration and must be read with respect to the annexed drawings wherein.

DETAILED DESCRIPTION OF THE DRAWINGS

Figure 1:
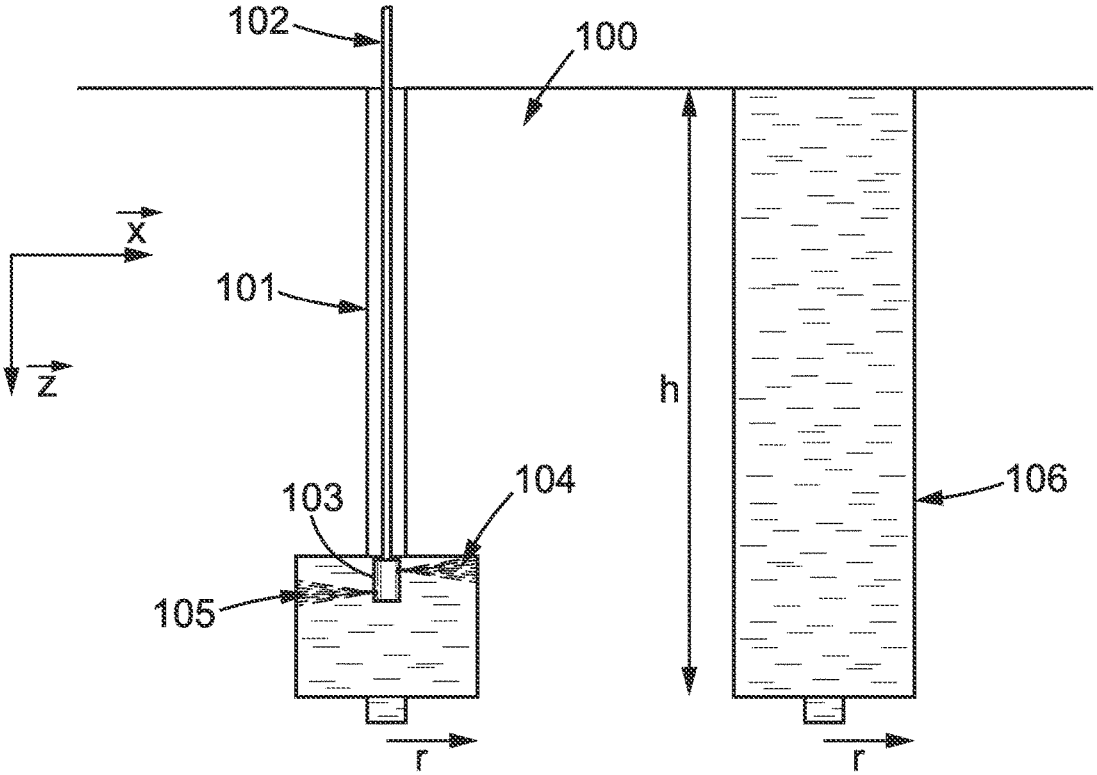
FIG. 1 shows a particular embodiment of the method for insulating sub-soil according to the invention.

FIG. 1 shows a particular embodiment of the method for insulating sub-soil according to the invention.

The mechanical destructuring of the sub-soil, the injecting of an insulating material into this sub-soil and the mixing of the whole can be carried out in many ways. For the purposes of illustration, it is possible to dig the ground with a shovel or a mechanical device of the excavator type in order to destructure the ground, inject at the surface of the dug ground the desired insulation and mix the whole manually.

Advantageously, it is also possible to:

drill a well 101 in the sub-soil 100 using a conventional drilling device;

introduce a nozzle 103 fixed to an injection rod 102 into the well and to the bottom of the well;

place in rotation the injection rod and the nozzle;

once in rotation, inject from the nozzle, according to an axis radial to the axis of rotation of the latter (i.e. in a horizontal plane in FIG. 1), a liquid 104 that makes it possible to destructure the sub-soil and an insulation 105 to be mixed with the ground.

The term "treated" sub-soil or "insulated" sub-soil is used to refer to a portion of the sub-soil that has been mixed with an insulation as indicated hereinabove.

The liquid making it possible to destructure the sub-soil is, for example, water. Advantageously, this liquid is injected at very high pressure so that it is able to destructure the sub-soil effectively. Moreover, and in particular in the framework of a permafrost sub-soil, it can be advantageous to inject a liquid of which the temperature is greater than 0° C. in order to melt the frozen sub-soil, for example more than 20° C., 30° C., 50° C., 70° C. or even 100° C. above the temperature of the sub-soil under consideration.

The injection is carried out by raising the nozzle 103 in the well 101. Due to the effectiveness of the destructuring jet (which is linked to the properties of the sub-soil and to the pressure of the destructuring liquid injected), the mixture between the sub-soil and the insulation is effective within a radius r about the axis of the well.

In the end, a column 106 of height h and of radius r is "treated" and is as such considered to be an "insulated" sub-soil.

It is also possible to add to the device described (possibly by replacing the injection of the destructuring fluid) a mechanical device for mixing such as a blade or helix set into rotation by the rotation of the shaft 102 and mechanically mixing the sub-soil with the insulation.

The insulation can advantageously be an insulation of the polyurethane or epoxy foam type that confers the qualities of resistance and solidity required as well as the thermal performance sought.

This insulation can also be perlite (insulation beads) associated for example with a cement slurry.

Figure 2:
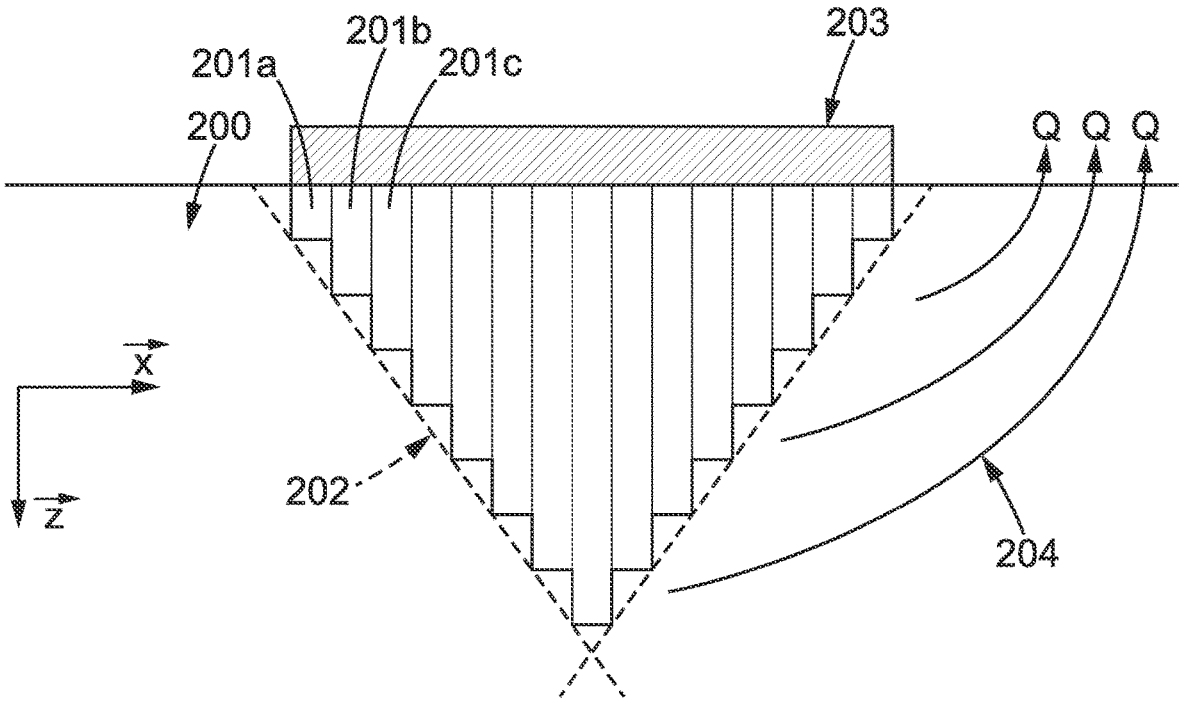
FIG. 2 shows a particular form of insulating the sub-soil in an embodiment according to the invention.

FIG. 2 shows a particular form of insulation of the sub-soil in an embodiment according to the invention.

The method, described in relation with FIG. 1, can be repeated a large number of times in the same zone, with the "treated" portions of the sub-soil able to be associated (i.e. adjacent) or practically associated (with the horizontal distances between two treated columns being less than r).

Advantageously, the general shape of the portions of the "treated" sub-soil 200 (201*a*, 201*b*, 201*c*, etc.) forms an inverted cone 202 as shown in FIG. 2. The base of this cone (at the surface of the sub-soil) can be used as a support for the construction of a screed of concrete or of any other construction on the ground.

This shape can allow for a better penetration of the cold under the portions of treated sub-soil (i.e. better extraction of heat under the portions of the treated sub-soil, marked with arrows 204). As such, the sub-soil in contact with the inverted cone 202 can remain frozen and as such participate in the solidity of the foundations of the screed 203 or any other installation on the surface.

Figure 3A:
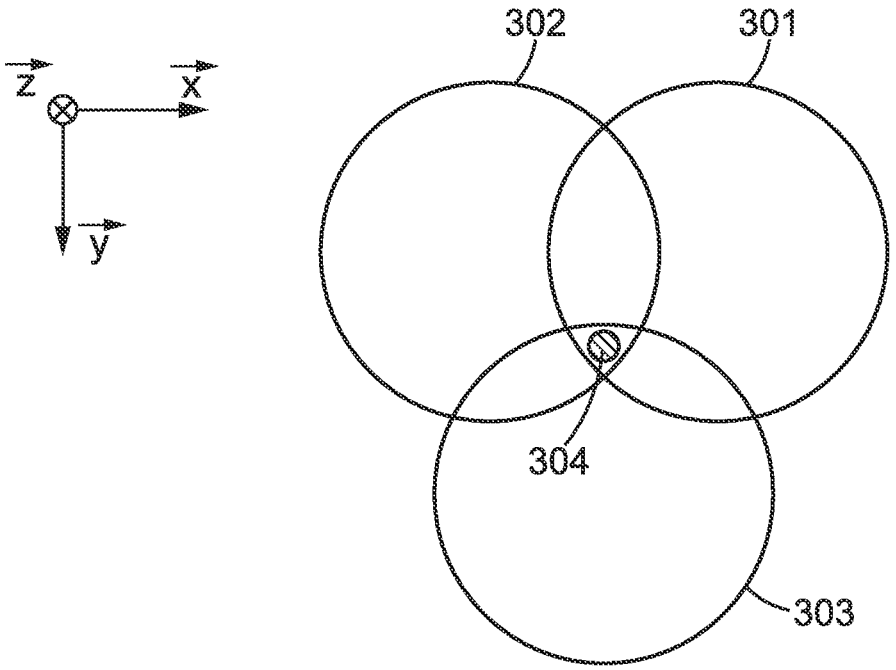
FIGS. 3*a* and 3*b* show the drilling of an operating well in the framework of an insulated sub-soil in an embodiment of the invention.
Figure 3B:
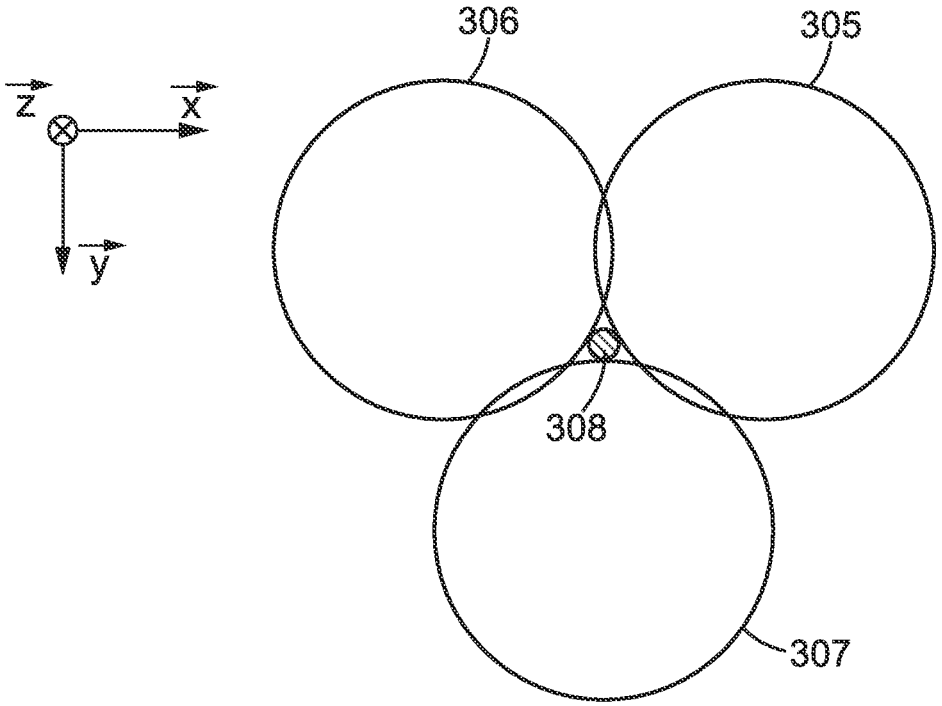

FIGS. 3*a* and 3*b* show the drilling of an operation well in the framework of an insulated sub-soil in an embodiment of the invention.

In order to carry out a drilling for a production well of hydrocarbons, it is possible, beforehand, to insulate a portion of sub-soil as described hereinabove, then to drill a well in this portion of insulated sub-soil.

The depth of the portion of the treat sub-soil for an insulation (e.g. 40-100 m) can, of course, be less than the complete depth of the well (e.g. 2000 m).

In a possible embodiment of the invention (FIG. 3*a*), it is possible to insulate several columns of sub-soil (301, 302, 303) as described hereinabove, with these portions being adjacent. The drilling 304 is then carried out in an insulated zone of the sub-soil. This embodiment is advantageous in particular if the mechanical properties of the treated sub-soil are more favourable to a drilling that the mechanical properties of the untreated sub-soil (e.g. lower density, lower mechanical abrasion, etc.).

In another possible embodiment of the invention (FIG. 3*b*), it is possible to insulate several columns of sub-soil (305, 306, 307) as described hereinabove, with these portions being adjacent but separating spaces of untreated sub-soil exist between these portions. The drilling 308 is then carried out in one of these untreated zones of the sub-soil. This embodiment is advantageous in particular if the mechanical properties of the treated sub-soil are less favourable to a drilling than the mechanical properties of the untreated sub-soil e.g. higher density, higher mechanical abrasion, etc.).

Of course, this invention is not limited to the embodiments described hereinabove as examples; it extends to other alternatives.

Other embodiments are possible.

For example, FIGS. 3*a* and 3*b* show three columns (portions of insulated sub-soil) but any other number is possible.

Moreover, it is also possible, in combination with or in place of what was indicated hereinabove, to prevent the destabilisation of the permafrost due to the use of cement during the drilling of wells or the production of fluids from these wells.

During the setting of the cement, the chemical reaction (transformation of the silicates and aluminates into hydrate) is an exothermic reaction. The heat generated will melt the permafrost. The environment in close proximity to the well will then be destabilised.

In the case where a cement or other materials are used during the production phase, the fluid coming from the sub-soil is raised to the surface. This fluid is at a high temperature and its heat can dissipate in the well. This can again lead to a destabilisation of the permafrost.

It is therefore preferable to have a cement with low hydration heat. But in the case where the fluid raised to the surface is very hot and the flow rate is substantial, the low thermal conductivity of the cement cannot suffice. It is then useful to associate it with a material that has a very low thermal conductivity.

The resulting composition can limit the thermal exchanges between the well and the permafrost. It must thermally insulate the sub-soil, while still supplying, preferably, mechanical support to the well.

There are today various materials that are added to the cement, for example vermiculite, or hollow beads. However, the hydration heat and the thermal insulation capacity do not make it possible to guarantee that the permafrost is not destabilised.

There is therefore a need for a composition that comprises at least one cement and a material with a low thermal conductivity, able to thermally insulate the sub-soil sufficiently in order to not destabilise the permafrost.

The invention consists in applying a composite material, for example syntactic foam, on the casing of the well, in order to have good thermal insulation, and in injecting a cement between the formation and the syntactic foam. The cement is preferably with low hydration heat, so as not to destabilise the permafrost during its setting and to give if possible a low thermal conductivity in order to reinforce the insulation.

The composite material cannot be used alone, as it is necessary to fill in the space between the permafrost and the material. The cement with low hydration heat and low thermal conductivity fulfils this role.

By way of example, an insulating composite material alone has a low thermal conductivity (of about 0.03-0.05 W/m·K), although it is about 0.9 W/m·K for a net cement (water+cement class G HSR). The thermal conductivity of the cement can be lowered to 0.4 or 0.5 W/m·K by adding various materials to it and optimising the porosity. The following two examples show the impact of the concentration in insulating material on the thermal conductivity then the impact of the porosity. These tests are carried out with a cement class G which does not have a low hydration heat. It can be seen that the higher the concentration in insulating material is, the lower the thermal conductivity is. However, beyond 55% porosity, there is no more further decrease in the conductivity.

Figure 4:
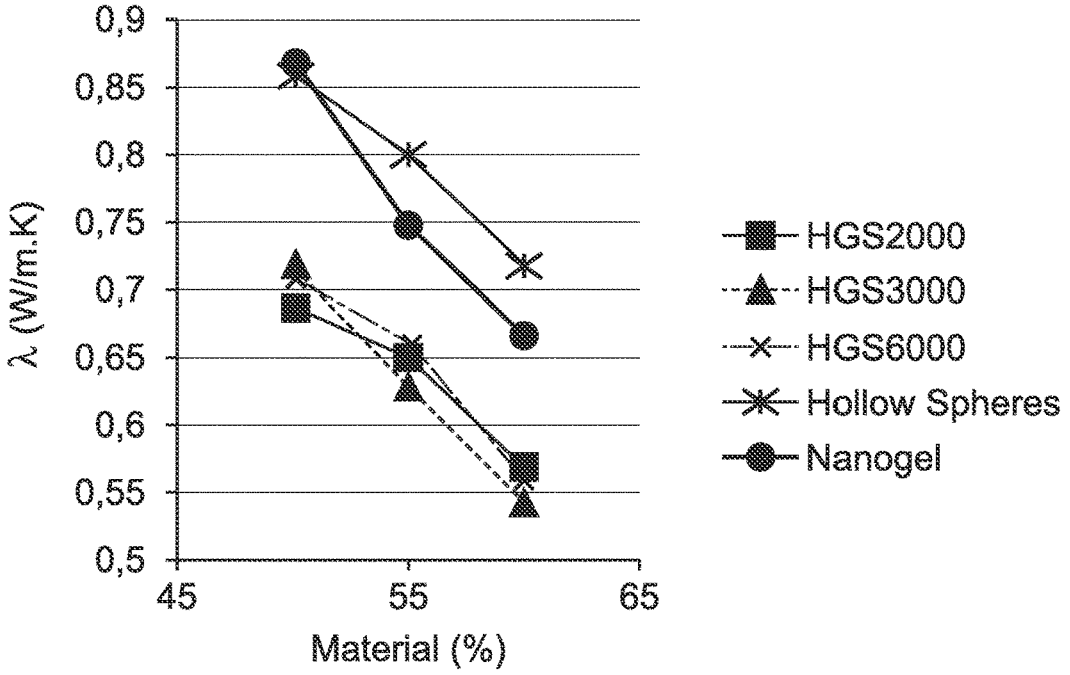
FIG. 4 shows a thermal conductivity λ according to the concentration of certain materials.

For the purposes of illustration, FIG. 4 gives examples of thermal conductivity $\lambda$ curves according to the concentration of certain materials. Cement is in particular composed of drilling cement (Cemoil) of class G, silica, hollow spheres (50 to 60%), an anti-foaming agent, a dispersant, an anti-settling agent, and water.

Figure 5:
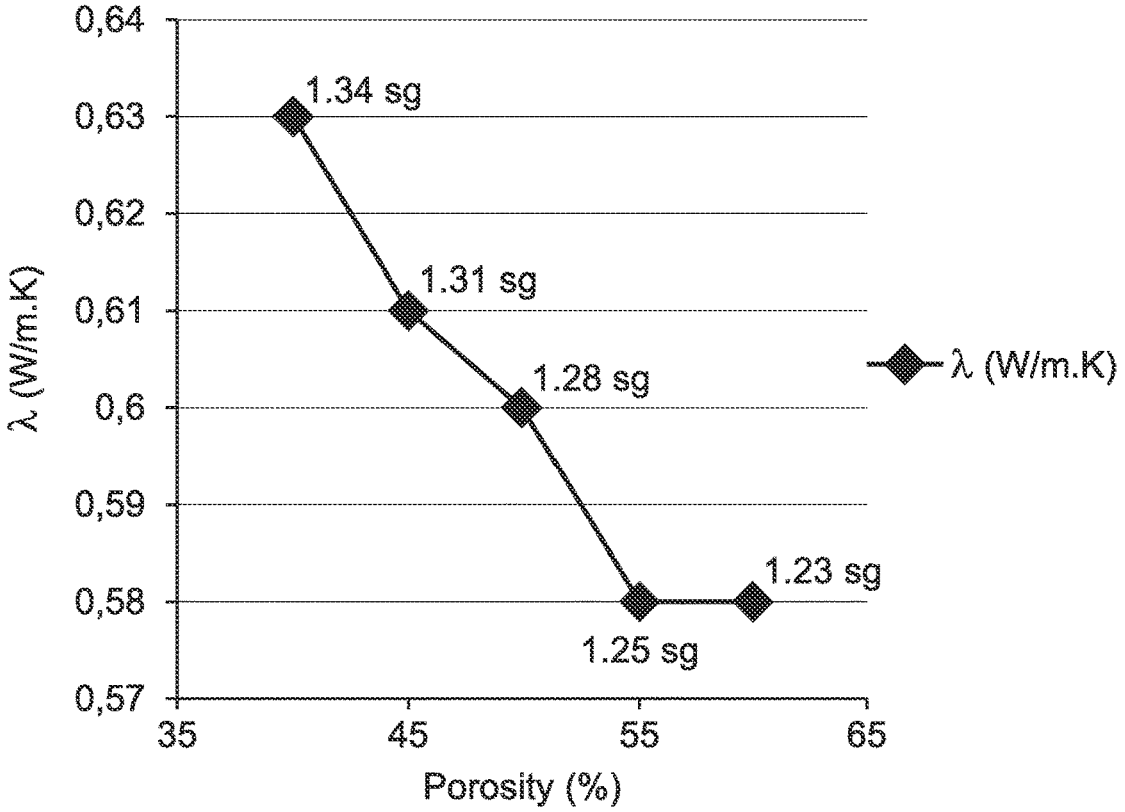
FIG. 5 shows a thermal conductivity λ according to the porosity of the cement.

In addition, FIG. 5 gives an example of a thermal conductivity $\lambda$ curve according to the porosity of the cement.

The utilisation of a cement with a low hydration heat and containing a material in order to obtain a low thermal conductivity, combined with an insulating composite material, makes it possible to obtain a quality of insulation that is much higher than existing solutions.

It is preferable that the cement with low hydration heat be different from a conventional cement, for example diluted with another material (such as silica or carbonate), in order to have good mechanical properties.

It can be observed experimentally that the resistance to compression for a cement class G, net or conventional cement and two other cements, with low hydration heat are substantially of the same magnitude.

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. A method for insulating a permafrost sub-soil comprising the steps of:

/a/ mechanically destructuring said sub-soil;

/b/ injecting an insulating material into said destructured sub-soil;

/c/ mixing said destructured sub-soil and said insulating material to form a mixed sub-soil;

wherein the thermal conductivity of said insulating material is determined to be strictly lower than the thermal conductivity of the sub-soil;

repeating the method to form an inverted cone with the mixed sub-soil, wherein a base of said inverted cone is at a surface of the sub-soil, wherein the destructuring of said sub-soil comprises drilling a vertical injection well; and said insulating material comprising a material with a low thermal conductivity and at least one cement with low hydration heat and low thermal conductivity.

2. The method according to claim 1, wherein the destructuring of said sub-soil further comprises:

displacing an injection nozzle in the vertical injection well;

injecting, during the step of displacing, a destructuring fluid at high pressure able to destructure the sub-soil via said injection nozzle;

and wherein the injection of said insulation is carried out during said displacement.

3. The method according to claim 2, wherein a temperature of said destructuring fluid is 20° C. higher than a temperature of the ground.

4. The method according to claim 1, wherein the mixing of said permafrost sub-soil and of said insulating material comprises:

rotating a mechanical shaft in said sub-soil.

5. The method according to claim 1, wherein the insulating material comprises a material that solidifies after injection.

6. The method according to claim 5, wherein the solidification comprises an exothermic reaction.

7. The method according to claim 1, wherein the insulating material comprises a hydrophobic material.

8. The method according to claim 1, wherein the method further comprises:

/d/ drilling a production well in said sub-soil mixed with said insulating material.

* * * * *